US007044450B2

(12) United States Patent
Striebel et al.

(10) Patent No.: US 7,044,450 B2
(45) Date of Patent: May 16, 2006

(54) QUICK RAIL SYSTEM WITH ADJUSTABLE SUPPORT

(75) Inventors: Roman F. Striebel, Duxbury, MA (US); Patrick A. Striebel, Pembroke, MA (US)

(73) Assignee: Suncor Stainless, Inc., Pembroke, MA (US)

( * ) Notice: Subject to any disclaimer, the term of this patent is extended or adjusted under 35 U.S.C. 154(b) by 183 days.

(21) Appl. No.: 10/464,094

(22) Filed: Jun. 18, 2003

(65) Prior Publication Data

US 2003/0213948 A1 Nov. 20, 2003

Related U.S. Application Data

(63) Continuation-in-part of application No. 10/154,213, filed on May 23, 2002.

(60) Provisional application No. 60/293,040, filed on May 23, 2001.

(51) Int. Cl.
*E04H 17/24* (2006.01)

(52) U.S. Cl. ..... 256/65.16; 256/59

(58) Field of Classification Search ..... 256/19, 256/59, 65.01–65.05, 65, 16
See application file for complete search history.

(56) References Cited

U.S. PATENT DOCUMENTS

| | | | | | |
|---|---|---|---|---|---|
| 3,076,636 | A | * | 2/1963 | Blum | 256/67 X |
| 3,511,477 | A | * | 5/1970 | Seery | 256/67 |
| 4,703,769 | A | | 11/1987 | Harrison, Jr. | |
| 4,856,761 | A | | 8/1989 | Berner | |
| 5,288,048 | A | | 2/1994 | Shreiner | |
| 5,427,359 | A | | 6/1995 | Moulton | |
| 5,437,433 | A | | 8/1995 | Rezek | |
| 5,551,194 | A | * | 9/1996 | Toomey | 256/65.16 X |
| 5,765,812 | A | | 6/1998 | Guenther | |
| 6,176,472 | B1 | * | 1/2001 | Burger | 256/59 |
| 6,802,496 | B1 | * | 10/2004 | Preta | 256/65.04 |
| 2002/0134976 | A1 | | 9/2002 | Swartz | |
| 2003/0193049 | A1 | * | 10/2003 | Kim | 256/67 |
| 2004/0099855 | A1 | * | 5/2004 | Platt | 256/65.05 |

* cited by examiner

*Primary Examiner*—John R. Cottingham
(74) *Attorney, Agent, or Firm*—Perkins Smith & Cohen LLP; Jacob N. Erlich; John A. Hamilton

(57) ABSTRACT

A modular railing system with handicap access is disclosed based on commercially available tubing assembled into a railing through use of fittings that connect to each other and the rails and posts of the railing system to allow all possible standard rail configurations. All connections are thereby held together by mechanical, rather than welded, connections.

19 Claims, 14 Drawing Sheets

Fig 9a
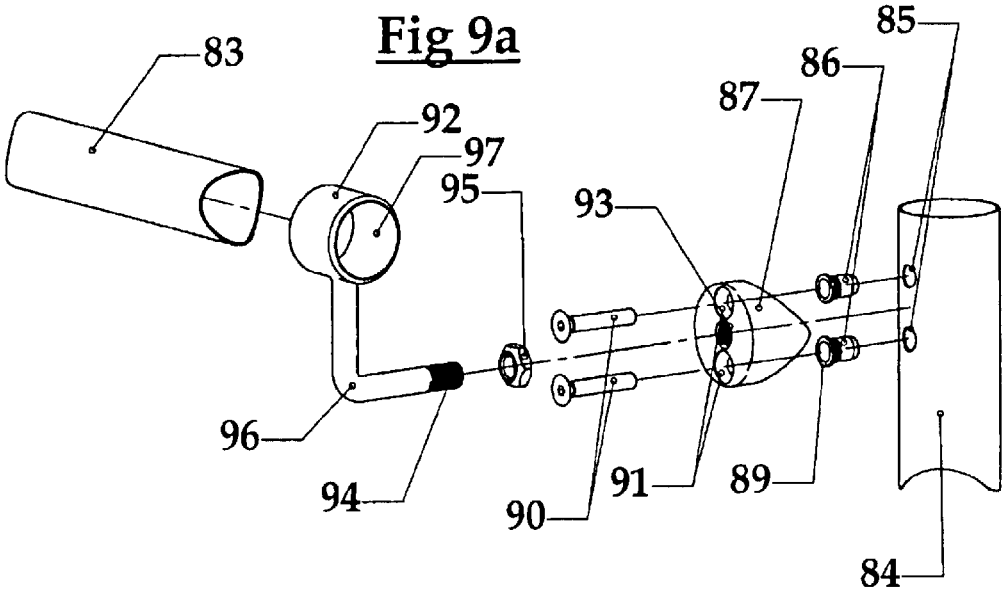
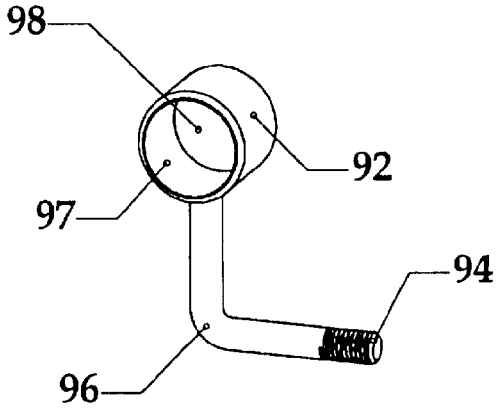
Fig 9b
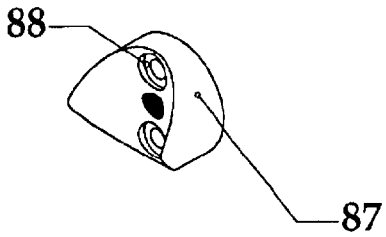
Fig 9c

QUICK RAIL SYSTEM WITH ADJUSTABLE SUPPORT

CROSS REFERENCE TO RELATED APPLICATIONS

This application is a continuation-in-part of pending U.S. patent application Ser. No. 10/154,213 entitled "Quick Rail System", filed May 23, 2002, which claims priority to Provisional Application Ser. No. 60/293,040 entitled "Quick Rail System", filed May 23, 2001, said applications being incorporated herein by reference.

FIELD OF THE INVENTION

This invention relates generally to railings, and, more particularly to modular systems with handicap access suitable for commercial and private railings and balustrades.

BACKGROUND OF THE INVENTION

Metal railing systems, but more especially stainless steel railing systems, presently on the market usually require components to be welded together to form the required shapes and frames. This can only be achieved in a workshop environment, and is very time consuming due to the required polishing of the welded seams. Existing modular metal railing systems include connections that are either complicated, unsuitable for consumer installation or unsightly, making most of these systems only suitable for factory or some commercial installations.

In addition, the requirements of many building authorities for vertical spacing of spindles or similar components in balusters to prevent small children from falling through the gaps, makes the use of existing stainless components prohibitively expensive, as those systems are labor intensive and/or require many fittings.

It is, therefore, desirable to improve the ease of installation and construction of railings for decks, balconies, marine docks, tennis courts, and other applications, which require a barrier for safety, esthetics or a separation.

It is similarly desirable to minimize the number of components required to cover virtually all variations encountered in the above applications, and to design said components in such a way as to enable installation by moderately skilled consumers with very simple tools, or by professional contractors in far shorter installation times than is possible presently.

Other desirable characteristics of railing systems include corrosion resistance, minimal maintenance and price competitiveness with respect to other railing materials.

SUMMARY OF THE INVENTION

The present invention provides a modular railing system that is easy to install and maintain, durable and compares favorably with respect to cost when compared to other systems available. Further, the present invention permits use of either vertical spindles or balusters, or the use of virtually any horizontal cable or wire system on the market today, as determined by architects and/or in accordance with any relevant building regulations. These advantages as well as further and other advantages of the present invention are achieved by the embodiments of the invention described herein below.

The invention is based on commercially available stainless steel (or other material) tubing, which is connected into a railing, or into a framework by especially designed fittings, which allow all possible standard rail configuration. The common item to all such fittings is a special dovetail connector that accepts all fittings, and which is easy to attach to the tubing, yet provides a safe and largely tamperproof connection.

The outer framework of the tubing is similar for virtually all applications, whether the inside is comprised of commercially available horizontal wire or cable systems, or employs spindles in a baluster system. Both alternatives are deemed within the scope of the present invention, however the lower tubing is optional for the horizontal cables embodiment.

Whereas most installations require vertical tubing or "uprights" to be mounted on a horizontal surface, it is sometimes desirable to attach uprights to a vertical surface, and therefore the present invention provides a railing system designed for both possibilities.

It is also a common requirement for steps to lead from or to a railing, and for these steps to either be in line or at right angles (either left or right) to the railing. All such possibilities are enabled by the railing system provided by the present invention, as are all possible angles of such steps either up or down, using an identical fitting.

Another capability common to railing systems in accordance with the present invention is that all connections may be held together by mechanical, rather than welded, connections. The connections may be further secured by commercially available adhesives such as epoxies, yet the system relies on the epoxy only to prevent rattles or vibration. The mechanical connections will hold safely even if the epoxy fails, has been badly applied, or is not used.

The present invention further provides customizable handicap access to railing systems such as the modular system described herein, but also to railing systems employing vertical tubular supports, with a minimal number of modular components. Existing handicap rails, especially for commercial buildings, are typically welded together as units and custom-made for each application. The present invention provides the ability to adapt a railing to varying degrees of a ramp, while maintaining at all times the posts vertical orientation and the top rail's parallel orientation with respect to the ramp slope.

The present invention provides a handicap grab rail that is attachable at any desired height to the posts and that maintains a slope parallel to the ramp. It is typically required or desirable that the grab rail be very strong, as the grab rail permits wheelchair-bound persons to pull themselves up the ramp. This use also makes it highly desirable that no obstruction be present along the top or sides of said grab rail, in order that said persons might easily grip the rail and slide their hands along it.

A handicap grab rail in accordance with the present invention provides maximum flexibility of design for handicap access with the fewest number of fittings. This allows transportation to a customer site of grab rail components rather than entire, custom-made rail sections. And similar to the rail system described above, all components are easily connected by professional contractors or skilled consumers.

BRIEF DESCRIPTION OF THE DRAWING

For a better understanding of the present invention, reference is made to the accompanying figures of the drawing, wherein:

FIGS. 9*a*–9*d* are schematic, pictorial illustrations of an assembly and components thereof for supporting a handicap grab bar from a vertical tube;

DETAILED DESCRIPTION OF THE INVENTION

A railing system according to the present invention comprises a plurality of vertical tubes or posts, one or more horizontal rails extending between adjacent posts, and a modular connecting means for connecting the vertical posts to the horizontal rails. Posts are installed on either a vertical or horizontal surface through a mounting base, either alone or in combination with a base bracket.

Figure 1A:
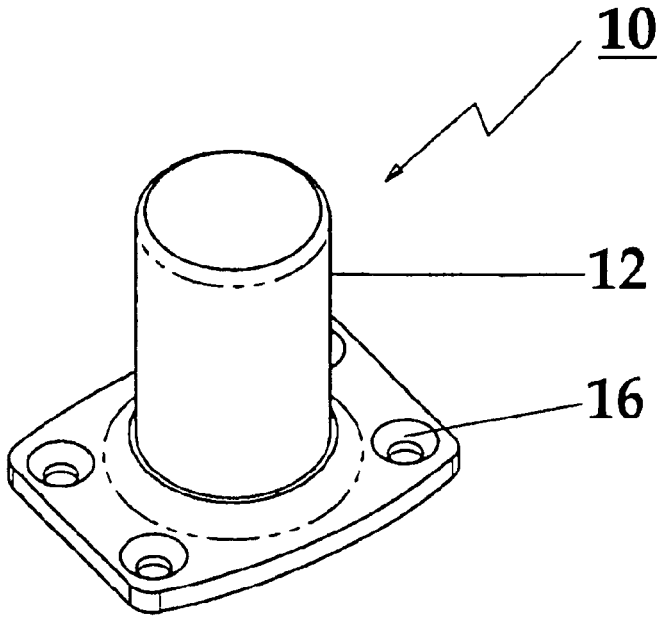
FIG. 1*a* is a pictorial view of a mounting base of this invention.
Figure 1B:
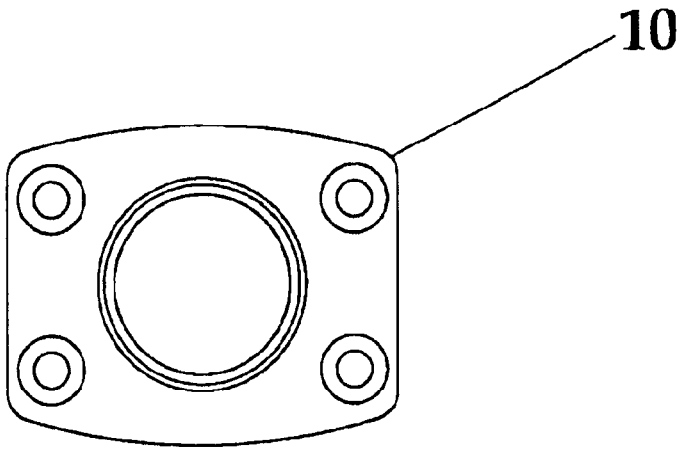
FIG. 1*b* is a bottom view of the mounting base of this invention.

FIGS. 1*a* and 1*b* illustrate a mounting base 10 used for all posts or uprights (the terms posts and uprights are used interchangeably herein to mean vertical support members.) Base 10 features a spigot 12, which fits snugly inside a standard tube (not shown). The base may also have recessed holes 16 for attachment to a surface or other railing system component by bolts or screws. Base 10 is preferably symmetrical, and can therefore be rotated 180° , which is of benefit since it reduces the number of prefabricated base assemblies required to be designed and manufactured for use with the railing system. An upright standard tube or post can be fitted on site to spigot 12 using an epoxy, or could be supplied with base 10 as a welded and polished assembly of a selected height, thus saving on installation time. It is also possible to use base 10 as a horizontally oriented tubular component, such as for connecting a horizontal rail component to a pre-existing wall.

Figure 2A:
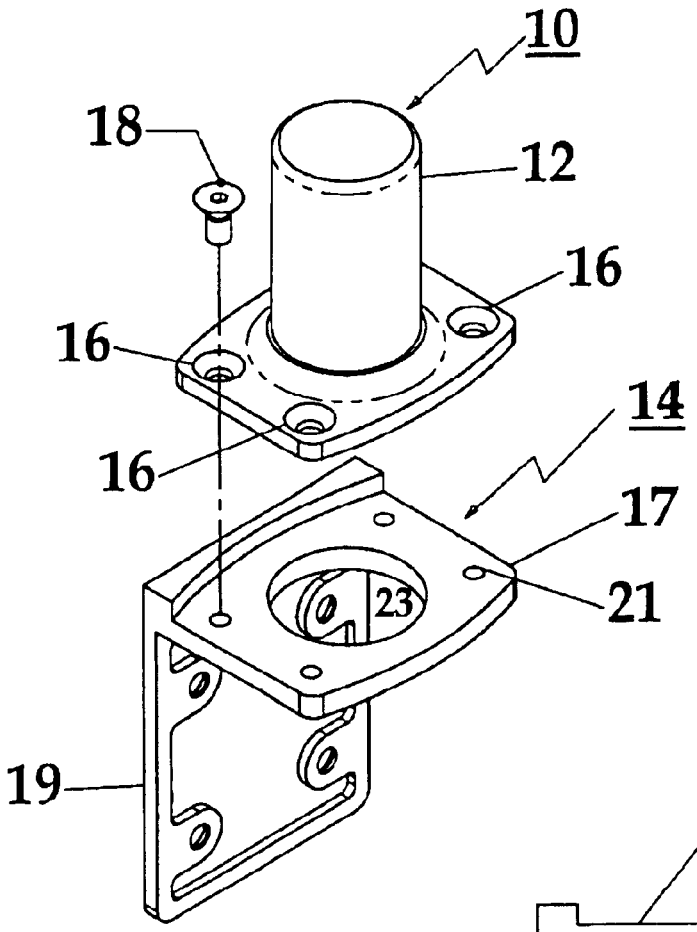
FIG. 2*a* is an exploded pictorial view of a base bracket for mounting on a vertical surface.
Figure 2B:
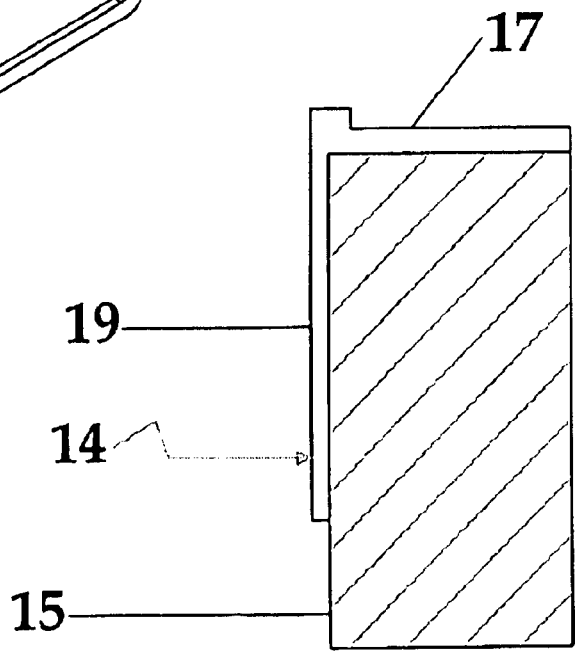
FIG. 2*b* is a pictorial side view of the base bracket mounted on a vertical surface.

FIG. 2*a* is an illustration of a base bracket 14 for use in vertically mounting the mounting base 10. Base bracket 14 is used when the railing needs to be mounted on a vertical surface 15, such as shown in FIG. 2*b*, inwards and over the top of the surface 15. The top flange 17 of the base bracket 14 is shaped in such a way as to accept the mounting base 10 and to provide a strong support against side loading from any direction. In FIG. 2*a*, top flange 17 is shown with an aperture 23 of the same radial dimension as spigot 12 of base 10. However, in an alternate embodiment (not shown), the top flange 17 may also be a solid layer of material without an aperture. If recessed holes 16 are used in the base 10, the top flange 17 may also have recessed holes 21 to receive screws or bolts for attachment. The recessed holes 16 in the base 10 are provided with screws 18 of a suitable size to allow mounting base 10 to be fastened to the top flange 17 of base bracket 14. Attached to the top flange 17 is a side flange 19 adapted for attachment to the vertical surface 15, as shown in FIG. 2*b*, through bolts, screws or other means, such as adhesives, known in the art depending upon the material of that surface.

Top flange 17 and side flange 19 are illustrated in an orthogonal configuration, but may be hingeably connected to allow attachment to surfaces not perfectly orthogonal. In another alternative embodiment, base bracket 14 may be configured to attach to surface 15 in such a manner as to enable base 10 to have a horizontal orientation. In yet another configuration, base bracket 14 will be a mirror image of the embodiment shown in FIG. 2*a*, which will allow a railing post to be mounted away from vertical surface 15 as opposed to inwards above the vertical surface 15. The same features and requirements of base bracket 14 discussed above will apply.

Figure 3A:
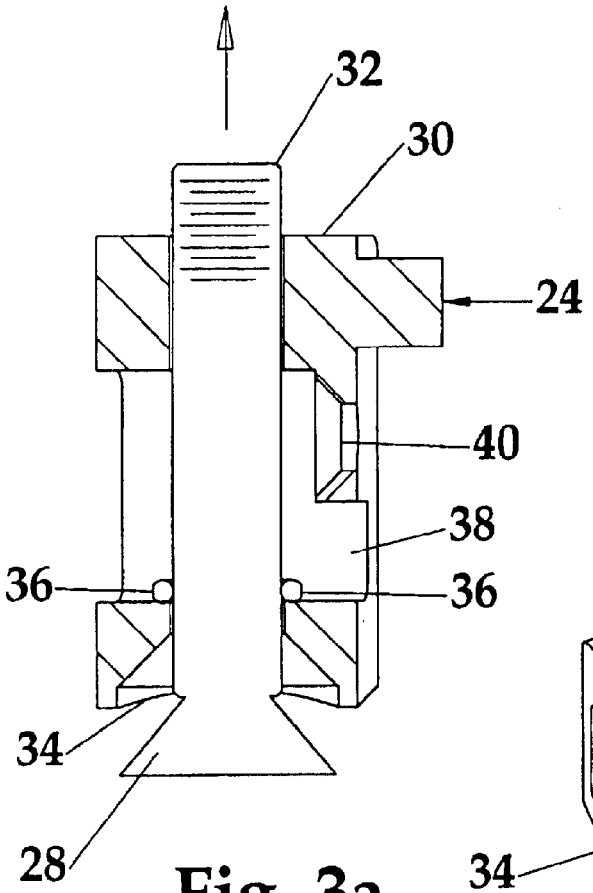
FIG. 3*a* is a partial cross-sectional view of a dovetail connector of this invention with a connecting screw.
Figure 3B:
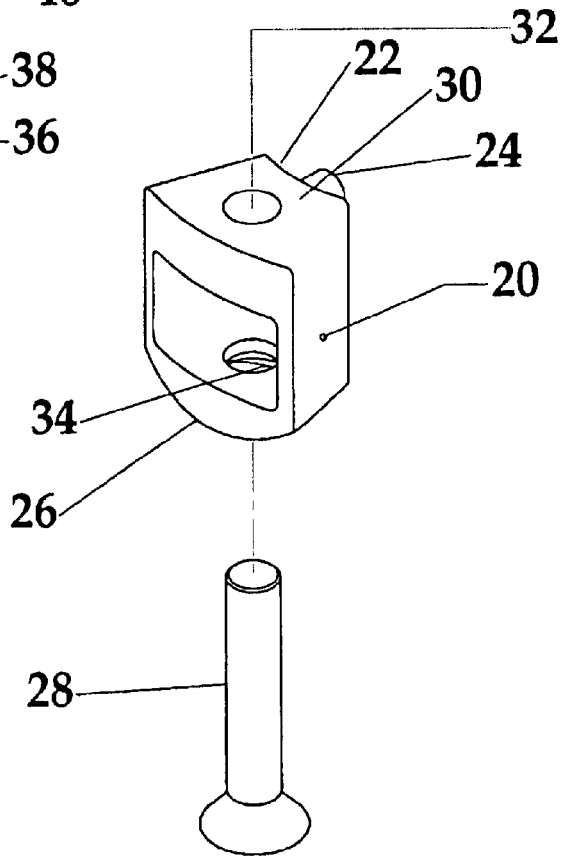
FIG. 3*b* is an exploded view of a dovetail connector of this invention shown with a connecting screw extending therefrom.

FIGS. 3*a* and 3*b* illustrate a dovetail connector fitting 20 for use with the present invention. This fitting is the component used to fix all other connective fitting components to the posts, except for base 10 and bracket 14, and serves to connect any vertical tube or post to any horizontal tube. The dovetail connector 20 has several unique features.

The backside 22 of dovetail connector 20 is shaped to a radius, which allows the connector to conform to the outer surface of a standard tube. In a preferred embodiment, the dovetail connector backside 22 has a short stub or spigot 24 and the standard tube or post to which connection is to be made has an aperture capable of receiving the stub or spigot. The spigot 24 aids in initial placement with respect to the tube, and greatly increases the shear strength vertically and horizontally when the system is in use. A commercially available adhesive such as glue or epoxy may also be used to secure the backside 22 of the dovetail connector to the post.

The underside 26 of the dovetail connector is shaped to perfectly reflect the circular cross-section of any of the fitting components used in conjunction with the dovetail connector 20. This is aesthetically pleasing and results in no sharp corners or edges. The dovetail connector top 30 is a substantially flat surface having an aperture 32 that is axially aligned with a corresponding aperture 34 in the underside 26. A suitable screw 28 inserted into aperture 34 on the underside 26, passes through aperture 32 in the top 30, thereby becoming available for tight connection to a threaded hole present on the fitted components used in conjunction with the dovetail connector 20 and providing axial alignment of said fitted components with the dovetail connector. A commercially available screw dimensioned to fill the apertures, and having a head that fits within a recess (not shown) on underside 26 and appropriate length to secure the fitted components may be employed.

To facilitate alignment of the connecting screw 28 during assembly, and to prevent the screw from getting lost, it is preferable to fit a commercially available rubber "O" ring 36 of suitable size over the screw 28 in such a way, that the end of the screw is flush with the top edge 30 of the dovetail connector 20. This screw 28 is therefore "pre-loaded" for final assembly.

In one embodiment, dovetail connector 20 has a center opening 38 to allow electric wires and the like, such as used to install LED lighting, to pass from the horizontal tubes into the vertical tubes. In another embodiment, dovetail connector 20 has a recessed hole 40 that can be used to permanently fasten the dovetail connector 20 to an upright tube, either by welding, screwing, riveting or permanent gluing.

Figure 4A:
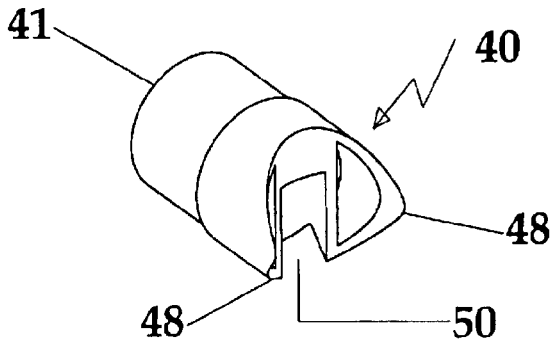
FIG. 4*a* is a pictorial view of a straight version of a rail connector of this invention.
Figure 4B:
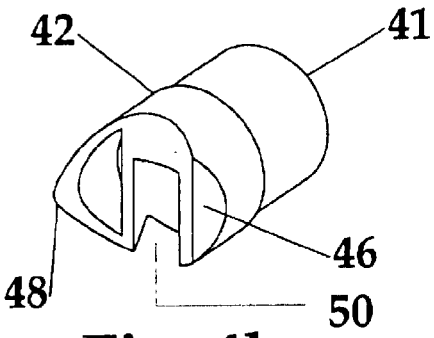
FIG. 4*b* is a pictorial view of a left version of a rail connector of this invention.
Figure 4C:
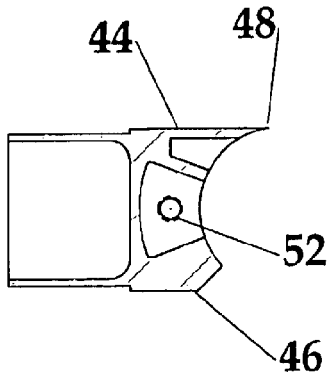
FIG. 4*c* is a cross-sectional view of a right version of a rail connector of this invention.
Figure 4D:
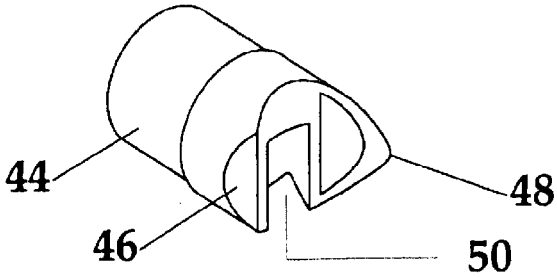
FIG. 4*d* is a pictorial view of a right version of a rail connector of this invention.

FIGS. 4*a–d* illustrate embodiments of rail connector fittings used in conjunction with the dovetail connector 20. A straight rail connector 40, shown in FIG. 4*a*, allows rails to be axially aligned, i.e. 180° with respect to each other, with a possibility of variations such as 5° variation from the center axis, if required. Left rail connector 42, shown in FIG. 4*b*, and right rail connector 44, shown in FIG. 4*d*, are nearly identical to the straight rail connector, except that each has a shortened wing 46 with respect to wing 48. This allows them to be placed next to each on the post such that the sides having the shortened wing 46 are adjacent, thus enabling formation of any desired angle from 90° to 170° with respect to each other. Angles from 60° to 90° can be achieved by using the same left and right rail connectors, however the shortened wing 46 will require trimming back to obtain the desired angle.

Referring also to FIG. 4*c*, there are several features common to all three fittings. The wings 46 and 48 are designed in such a way as to fit perfectly around the outside of a given tube, and to blend the horizontal tube into the vertical tube. This design is aesthetically very pleasing due to the lack of sharp edges or corners, and the wings 46 and 48 serve to further take significant side loads against the railing, such as those being experienced when a heavy person falls against it. In combination with the spigot 24 of the dovetail connector 20, which supports smaller vertical loads and assists in supporting horizontal loads, the rail system can take very significant side (horizontal) loads, which are essentially being limited only by the choice of tubing used.

The underside 50 of the rail connectors (40,42,44) is open and designed in such a way as to accept the dovetail connector 20 inside where it becomes hidden like a simple puzzle, except for the small exposed underside of it, which complements and closes the opening perfectly. An opening on the end of the rail connector opposite the wings 46 and 48 is shaped to receive the end of a rail component.

An internal threaded hole 52 near the top of the rail connector is designed to accept the end of the connecting screw 28 "pre-loaded" into the dovetail connector 20.

Figure 5A:
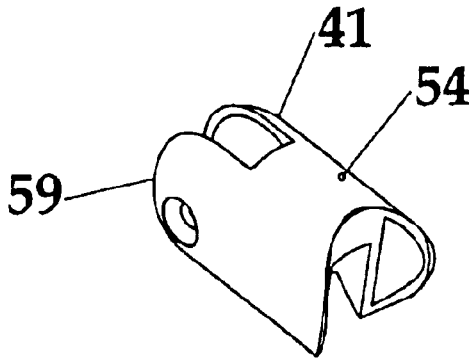
FIG. 5*a* is a pictorial view of a straight version of an adjustable rail connector of this invention.
Figure 5B:
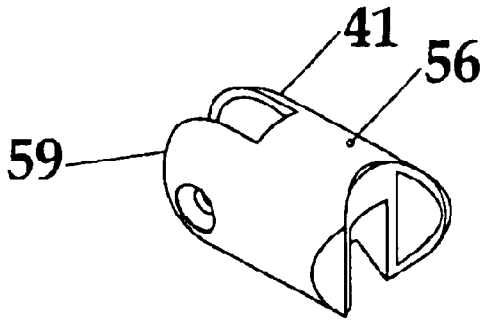
FIG. 5*b* is a pictorial view of a left version of an adjustable rail connector of this invention.
Figure 5C:
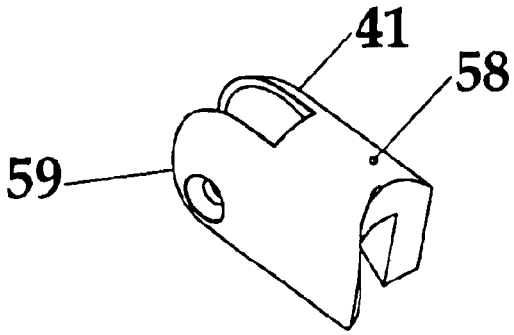
FIG. 5*c* is a pictorial view of a right version of an adjustable rail connector of this invention.

FIGS. 5*a–5c* illustrate three embodiments of stair rail connectors 54,56,58, a straight stair rail connector 56, a left adjustable rail connector 54 and right adjustable rail connector 58. The rail connectors are used to adjustably connect railings oriented to accommodate ascending/descending stairways. Each stair rail connector 54,56,58 is nearly identical to the rail connectors 40,42,44 described above and shown in FIGS. 4*a–4d*, except that an end 41 of each of the stair rail connectors 54,56,58 comprises a conventional knuckle joint 59 rather than the wing design of the rail connectors 40,42,44. The left adjustable stair rail connector 56 and right adjustable stair rail connector 58 have shortened wings, allowing them to be placed next to each other on a post such that the shortened wings are adjacent, just as a left rail connector 42 and right rail connector 44 may be placed next to each other. Further, a left rail connector 42 or right rail connector 44 may be placed next to a right stair rail connector 58 or left stair rail connector 54, respectively, by locating the sides of the connectors having a shortened wing adjacent to each other. In addition to all the features embodied in the standard rail connectors the three fittings have additional common features.

Figure 5D:
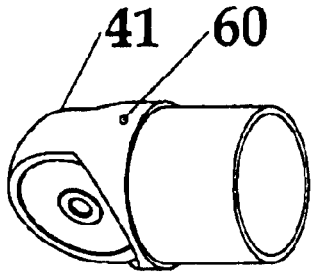
FIG. 5*d* is a pictorial view of a male rail adaptor of this invention.

With reference to FIG. 5*d*, an adjustable male rail adaptor 60 fits into the knuckle joints 59 of the stair rail connectors 54,56,58, and is secured by a commercially available connecting screw. This arrangement allows the stair rail to be positioned at an angle with respect to the central axis of a vertical post, and thus the same fitting can be used to orient a handrail at an angle complimentary to a stairway All possible standard uses of a connected stair handrail are covered such as a straight in-line connection, a left and right connection, and all of those either going up or down. A commercially available recessed screw fixes the up or down angle once selected.

Figure 6A:
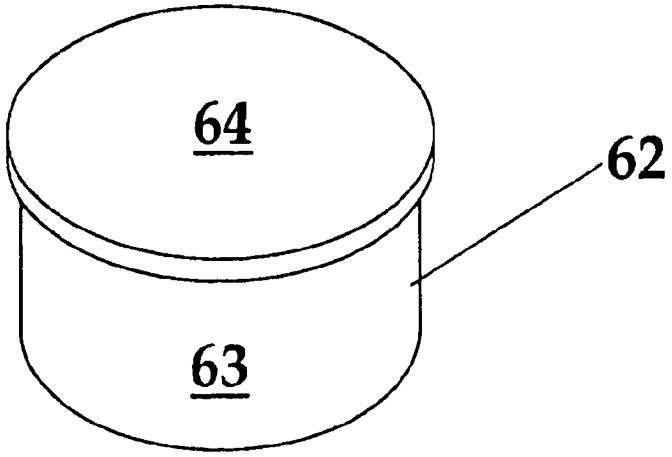
FIG. 6*a* is a pictorial view of one embodiment of a post cap used with a railing system of this invention.
Figure 6B:
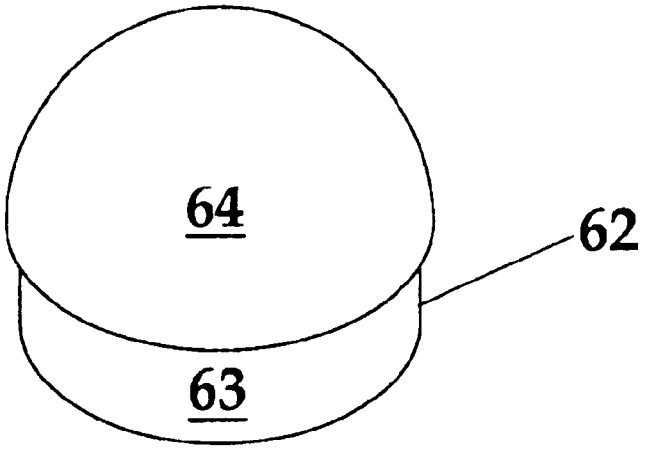
FIG. 6*b* is a pictorial view of a second embodiments of a post cap used with a railing system of this invention.

FIGS. 6*a* and 6*b* illustrate two embodiments of post caps 62 for use with the present invention to close the top of the vertical tube. Those skilled in the art will recognize that several varieties of caps may be used in the railing system, thus allowing for different appearances at a low cost. For example, the embodiment shown in FIG. 6*a*, the post cap 62 has a flat top surface, while in the embodiment shown in FIG. 6*b*, the post cap 62 has a domed crown, with other configurations also being acceptable. Each post cap is comprised of a bottom section 63 and a top section 64. The bottom section has an outer diameter comparable to the inner diameter of the tube into which the bottom section will be received, allowing a snug fit. The top section 64 has a maximum outer diameter comparable to the outer diameter of the tube into which the bottom section will be received.

Figure 7:
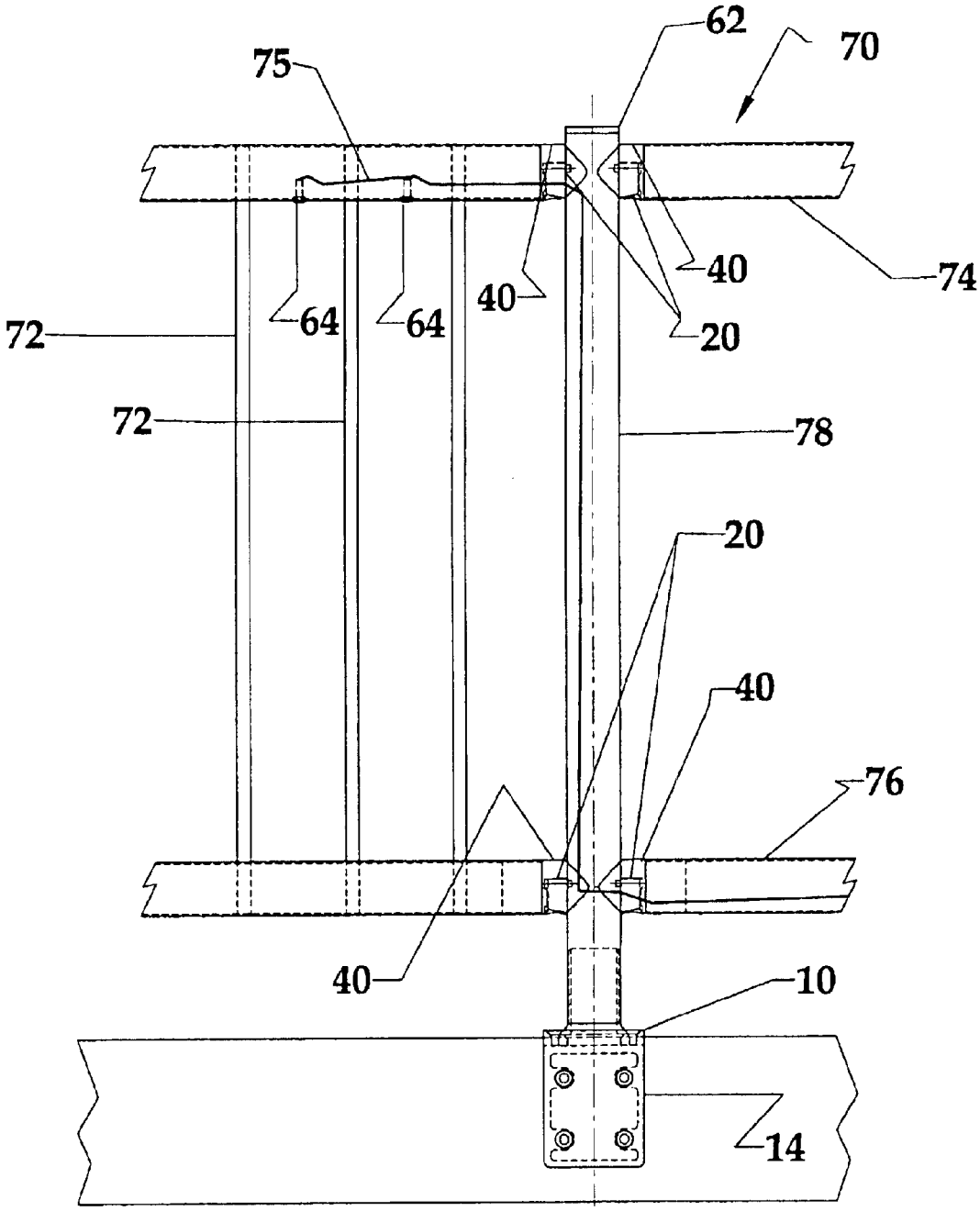
FIG. 7 is a side view of a railing system of this invention with spindles in a balustrade.

With reference to FIG. 7, which illustrates a railing system 70 in accordance with the present invention, the post caps 62 will be fitted onto the top of a rail post or tube 78. Preferably, a commercially available glue or epoxy is added, which has the simple function of preventing a possible loss of the cap 62. If the railing system 70 is fitted with LED lights 64, small size electric wires within each horizontal section can be reached and connected if the cap 62 is removed, and subsequent access for maintenance or replacement is possible.

The railing system 70 illustrated in FIG. 7 employs tubular components comprising vertical spindles in a baluster type arrangement. The local building code where a system is being assembled may specify a maximum distance between each spindle 72. At the desired spindle spacing, holes that match the outer diameter of the spindles 72 are located (or created, if necessary) in the underside of the top horizontal rail 74 and the top side of the lower horizontal rail 76 for receiving the spindles.

The spindles 72 are comprised of identical pieces of straight rod, each of which has a slight chamfer at each end to allow easier insertion into the holes. The length of each spindle 72 is approximately the same, and is determined by the desired distance between the top rail 74 and bottom rail 76. In one method of assembly, each section of railing is assembled on the floor or work surface by simply inserting the spindles 72 into the holes of the bottom rail 76 and the top rail 74. The length of the spindles 72 determines the total height of the baluster, since they contact the inner surfaces of the horizontal rails at the lowest and the highest points. A completed section is held together temporarily by tape, rubber "bungee cord" or similar, and then slotted into the four dovetail connectors 20 attached to the rail post 78 from the top and pushed down. Once the four hidden securing screws 28 (shown in FIGS. 3*a* and 3*b*) have been tightened, there is no possible movement by the spindles 72 as they are constrained tightly by the top rail 74 and bottom rail 76.

Figure 8:
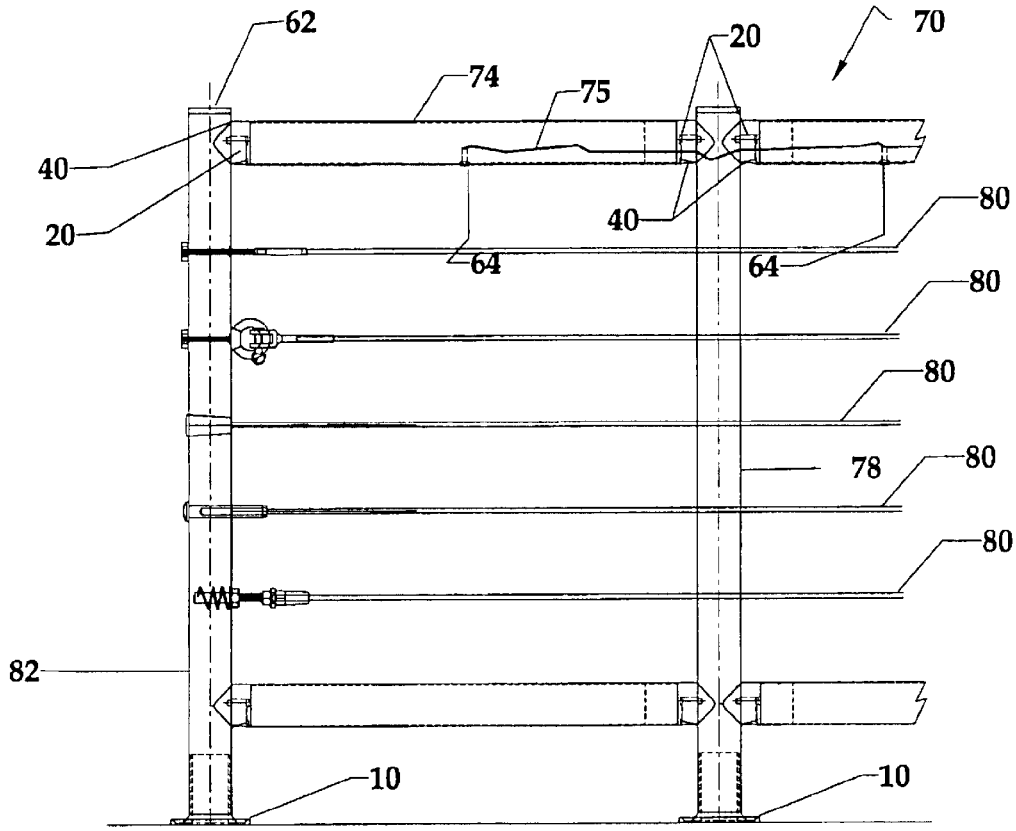
FIG. 8 is a side view of a railing system of this invention using commercially available wire rope systems.

FIG. 8 represents a rail system 70 alternatively configured with horizontal wire/rope strands 80 or similar commercially available cable. The rope 80 passes through each upright tube or rail post 78 at the desired height. Each horizontal wire rope strand 80 is attached to the end posts 82 and is tightened. The resulting horizontal pulling force obtained by the tensioning acts to compress the horizontal tubes and thus further strengthens the completed rail system 70. The rail system 70 of this invention may be used with many possible attachments and is not limited to the examples described herein. In one embodiment, LED Lights 75 are attached to the railing. Wiring for such LED lights is threaded through the rails and posts to make the railing more aesthetically pleasing.

Figure 9D:
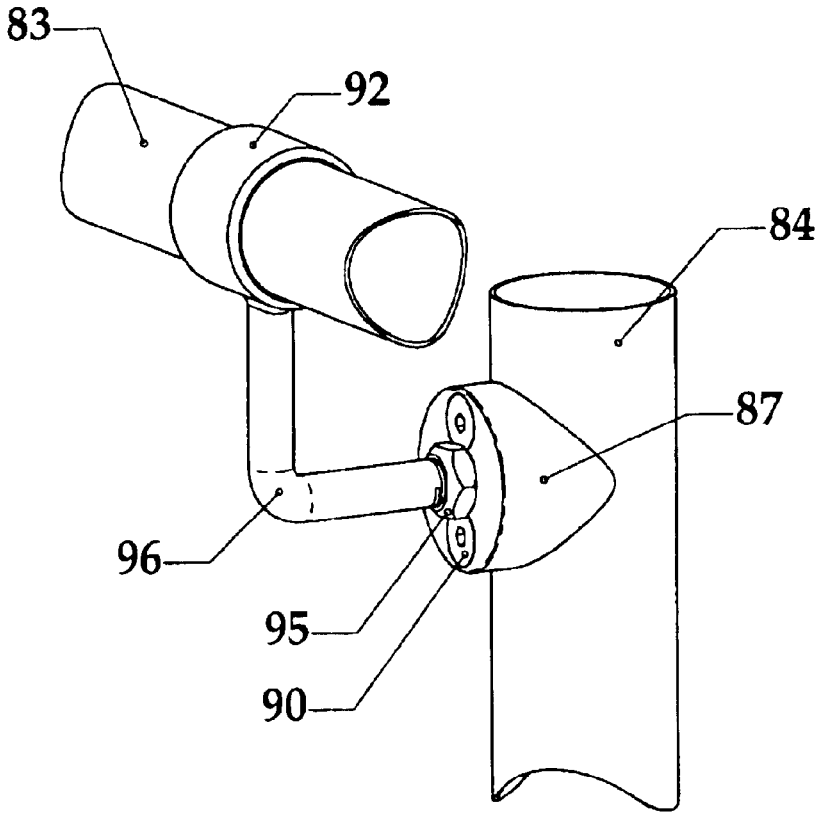
Figure 9E:
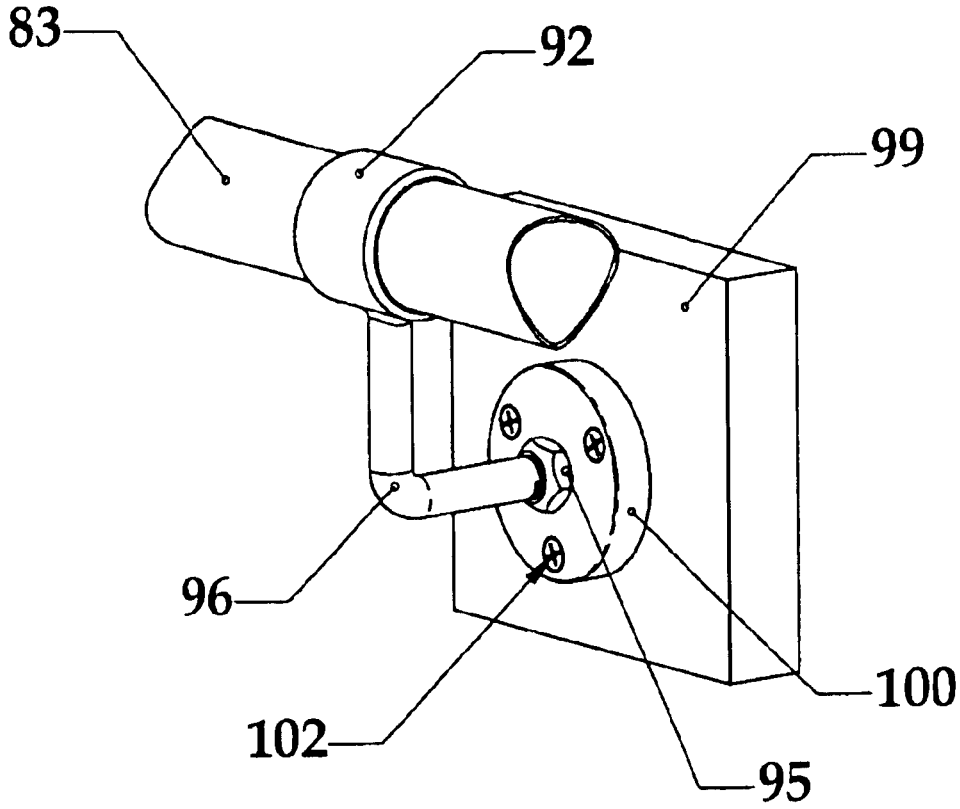
FIGS. 9*e*–9*g* are schematic, pictorial illustrations of an assembly and components thereof for supporting a handicap grab bar from any straight vertical surface.
Figure 9F:
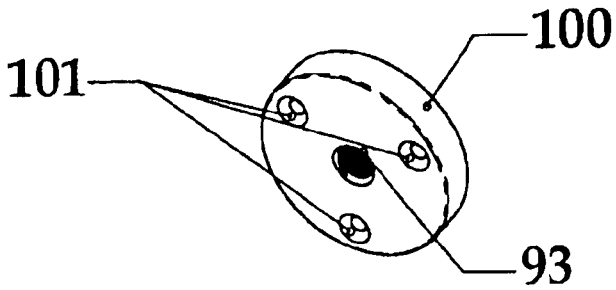

FIGS. 9*a*, 9*d* and 9*e* illustrate a grab rail 83, suitable, for example, for use by the handicapped, attached to a vertical surface 99 or tube 84. In a preferred embodiment, a plurality of holes 85 of suitable diameter are drilled into the tube 84 at a height just below the desired grab rail height, and commercially available rivet nuts 86, preferably composed of a sturdy and non-rusting material (e.g., stainless steel), are installed into the holes 85. A grab rail support mount 87 provides interconnection between a grab rail holder 92 and the vertical surface 99 or tube 84. The support mount 87 is shaped to provide a seamless fit, whether contoured (as in FIG. 9*c*) or flat (as in FIGS. 9*d*–*f*), when secured to the vertical surface or tube. The support mount 87 also preferably has a plurality of recesses 88 dimensioned to fit over the shoulders 89 of the installed rivet nuts 86.

The bolts 90 are inserted through the front of the support mount 87, preferably through another plurality of recesses 91, to provide a smooth surface on the face of the support mount. The bolts 90 are received and tightened into the rivet nuts 86, thereby forming a strong and secure mounting surface. A threaded end 94 of a grab rail holder 92 is threaded into a suitably threaded center hole 93 of the grab rail support mount 87. The thread of the threaded end 94 is no longer than necessary to accommodate a locking nut 95 and to allow the threaded end 94 to reach the surface of the vertical tube 84 or surface 99. After the end 94 is fully threaded into the center hole 93, it can be rotated backward to align with the desired slope of the grab rail 83, and once that orientation has been achieved, the grab rail holder 92 position can be locked by the locking nut 95. It should be noted that rivet nuts 86 are an optional part of the system, as bolts 90 could also comprise wood screws or other suitable means for securing support mount 87 to the vertical tube 84 or surface 99.

Figure 9G:
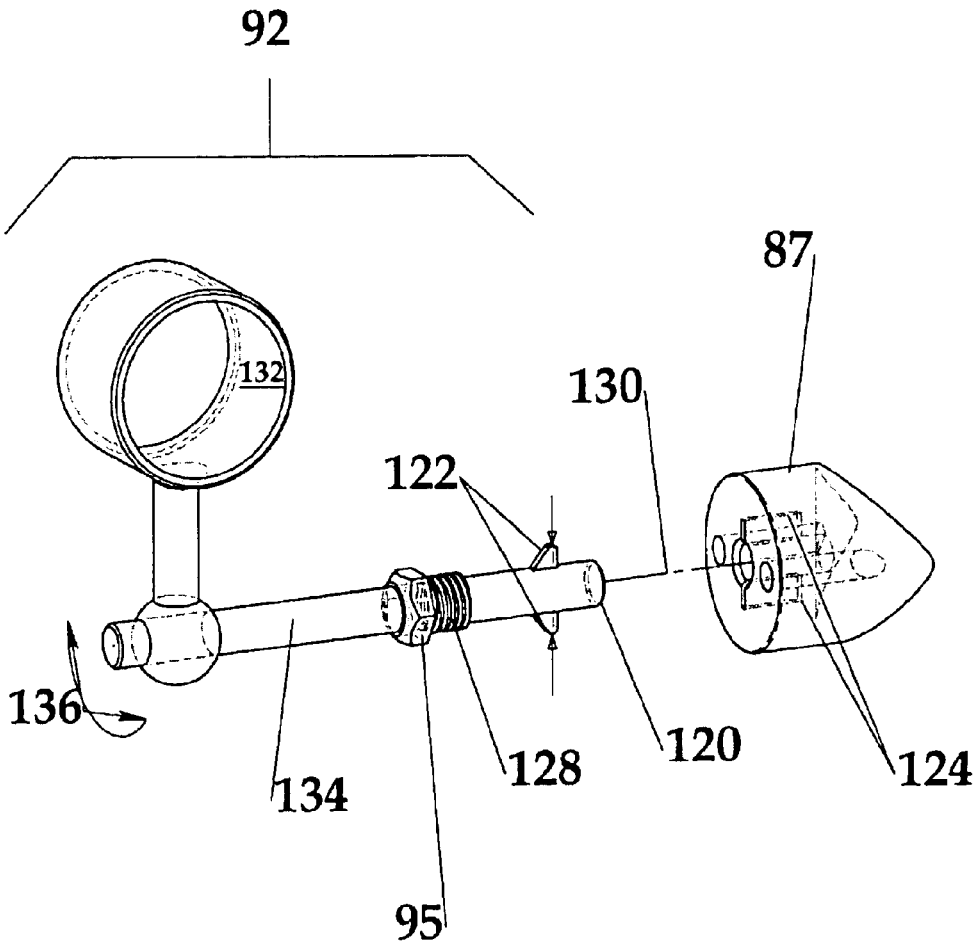

Other designs of the grab rail holder 92 are possible. FIG. 9*g* illustrates two alternative design features of grab rail holder 92. First, rather than being threaded, end 120 of an elongate member portion of the grab rail holder has one or more spring-loaded flanges 122 that extend and retract in a direction orthogonal to the central axis of the elongate member portion of the grab rail holder. The one or more flanges 122 are compressible to within the interior of the end 120. This allows the end 120 to be inserted, rather than screwed, into the aperture of support mount 87. The force provided by the flanges 122 as they extend outwardly from the elongate member and contact the inner wall(s) 126 of the tube in support mount 87 may provide sufficient friction to affix the end 120 with respect to the support mount. Preferably, however, the support mount is equipped with a corresponding groove 124 mateable to the flanges, into which the flanges snap into place in an extended position. If the groove is dimensioned circumferentially about the axis 130 of the hollow passage within the support mount, the portion of grab rail holder 92 including the eye may be adjusted a full 360° about the axis. An optional thread 128 and locking nut 95 may also be utilized in these single-piece embodiments to lock the angular position of the eye.

A second alternative design of the grab rail holder 92 involves constructing the holder of two pieces - an eye piece 132, and an elongate member piece 134, about which eye piece 132 is rotatable (as indicated by the directional arrows 136.)

Returning to FIG. 9*a*, grab rail holder 92 includes an eye 97 through which a grab rail 83 will pass, and a right angle 96 directly below the eye 97. This arrangement allows suitable spacing from the tube 84 or vertical surface 99, thereby ensuring that the entire outer surface of the grab rail 83 is available for hand placement with material interference from the supporting or mounting arrangement, or from the vertical surface or tube. The eye 97 has an inner diameter just wide enough to allow passage of the grab rail 83 with a snug fit. At each end of the grab rail 83 is a grab rail holder 92 with a capped eye 97, thereby forming a cup into which each end of the grab rail is set. This is best illustrated with reference to FIG. 9*b*, wherein one end 99 of the eye 97 is open and the other end 98 is closed. This design constrains movement of the grab rail even in stairway configurations wherein the grab rail orientation will not be horizontal.

Referring again to FIGS. 9*e* and 9*g*, the vertical surface 99 to which the grab rail holder 92 is fastened may comprise any flat surface providing sufficient support, such as a square tubing, wooden post, or wall or the like. In a preferred embodiment, the rail support mount 87 comprises a cylindrical disk including a plurality of holes 101 (as shown in FIG. 9*e*) to receive commercially available bolts or screws 102 for securing to the vertical surface 99. This configuration similarly provides angular adjustment of the grab rail holder 92 and thus the grab rail 83. Once the grab rail holder is adjusted to a desired angular slope, its position is fixed by tightening lock nut 95.

Figure 10A:
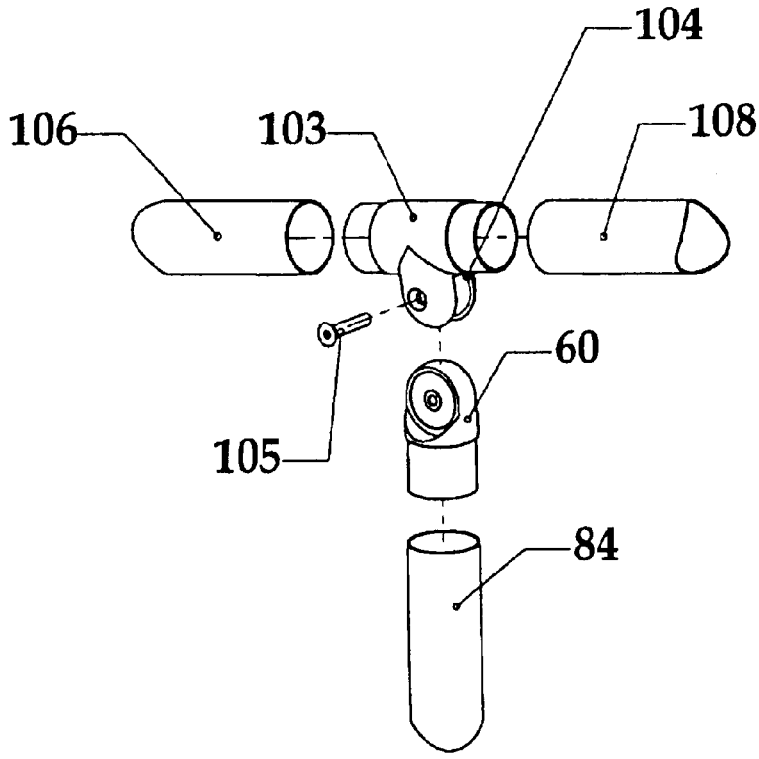
FIGS. 10*a* and 10*b* are schematic, pictorial illustrations of an angularly adjustable, vertically mounted rail support system in accordance with the present invention.
Figure 10B:
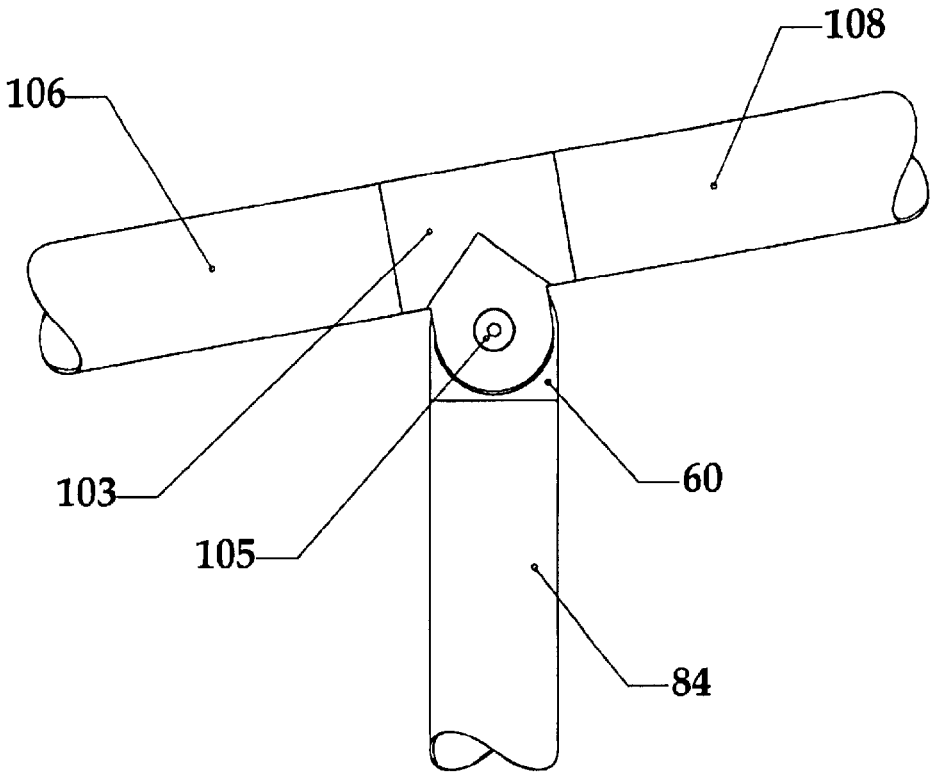

FIGS. 10*a* and 10*b* illustrate a modular, angularly adjustable top rail 106, for use on handicap access ramps, which is vertically mounted upon a vertical post or tube 84. Adjustment is effected by use of a "T" fitting 103 incorporating a clevis 104 shaped so as to receive an adjustable male rail adaptor 60 (as shown in FIG. 5*d*.) The clevis is recessed into the "T" fitting in such a way as to strengthen the "T" and to place the fulcrum as close as possible to the top rail 106. After orienting the top rail to the desired slope, which can be from 0° (horizontal) to 50° (as typically used on stairways), a commercially available (or modified for length) connection bolt 105 is tightened, thereby locking the adjustable "T" assembly in place.

Although the invention has been described with respect to various embodiments, it should be realized this invention is also capable of a wide variety of further and other embodiments. For instance, the embodiments described and depicted illustrate connection of the modular grab rail support system to vertical surfaces, such as walls or modular tubing. The tubes to which the grab rail support system is attached could just as easily be oriented horizontally themselves, or be solid, such as in cylindrical or rectangular posts unlike the tubing employed in the railing system of the present invention.

What is claimed is:

1. A modular, adjustable grab rail support system, comprising:

at least one grab rail mounting component, including an exterior surface shaped to conform to a vertical surface, a center hole oriented as to be orthogonal to the vertical surface, and at least one fastening hole parallel to the center hole to receive a fastening component to fasten the grab rail mounting component to the vertical surface;

at least one fastening component insertable through the at least one fastening hole to secure the at least one grab rail mounting component to the vertical surface;

at least one grab rail holder, including an angularly adjustable eye piece for receiving a grab rail, and an elongate member portion having an end dimensioned to fit into the center hole of the at least one mounting component.

2. The grab rail support system of claim 1, further comprising a locking mechanism for securing the at least one grab rail holder to the at least one mounting component at the desired eye piece angular position.

3. The grab rail support system of claim 2, wherein the locking mechanism further comprises:

a thread upon the elongate member; and a locking nut disposed about the thread and abutting the mounting component when the elongate member is fit into the center hole of the mounting component.

4. The grab rail support system of claim 1, wherein the end of the elongate member and the center hole of the include corresponding mated threads.

5. The grab rail support system of claim 4, wherein the threaded end of the grab rail holder is further dimensioned to screw into the threaded center hole until substantially abutting the vertical surface.

6. The grab rail support system of claim 1, wherein the end of the elongate member further comprises at least one flange orthogonally extendable from the elongate member.

7. The grab rail support system of claim 6, wherein the mounting component further comprises at least one groove for receiving the at least one flange.

8. The grab rail support system of claim 6, wherein extension of the flange locks the angular position of the eye.

9. The grab rail support system of claim 1, wherein:

the eye piece and the elongate member are two distinct, interconnected components; and the eye piece is rotatable about the elongate member.

10. The grab rail support system of claim 1, further comprising a corresponding plurality of mounting components and grab rail components.

11. The grab rail support system of claim 1, wherein the at least one fastening component is selected from the group consisting of screws, bolts, and rivets.

12. The grab rail support system of claim 1, further comprising at least one nut embedded within the vertical surface to receive the at least one fastening component.

13. The grab rail support system of claim 12, wherein the exterior surface of the at least one mounting component includes at least one recess concentric with the at least one fastening hole to receive a shoulder of the at least one nut.

14. The grab rail support system of claim 1, wherein the at least one grab rail holder includes an approximately 90° bend between the eye piece and the elongate member.

15. The grab rail support system of claim 1, wherein the eye piece includes a capped eye defining a cup to receive a first end of the grab rail.

16. The grab rail support system of claim 15, further comprising a second grab rail holder having an eye piece including a capped eye defining a cup to receive a second end of the grab rail, such that axial movement of the grab rail through the second grab rail holder eye is constrained.

17. The grab rail support system of claim 1, wherein the vertical surface comprises a wall.

18. The grab rail support system of claim 1, wherein the vertical surface comprises one or more solid posts.

19. The grab rail support system of claim 1, wherein the vertical surface comprises one or more hollow tubes.

* * * * *